US006421935B1

(12) United States Patent
Bartlett

(10) Patent No.: US 6,421,935 B1
(45) Date of Patent: Jul. 23, 2002

(54) ROCKING SHOE

(76) Inventor: Michael D. Bartlett, 2559 Holly Creek Dr., Marietta, GA (US) 30062

( * ) Notice: Subject to any disclaimer, the term of this patent is extended or adjusted under 35 U.S.C. 154(b) by 0 days.

(21) Appl. No.: 09/714,221

(22) Filed: Nov. 17, 2000

Related U.S. Application Data

(60) Provisional application No. 60/170,760, filed on Dec. 15, 1999.

(51) Int. Cl.[7] ..... A43B 5/18

(52) U.S. Cl. ..... 36/132; 482/79

(58) Field of Search ..... 36/132, 110, 7.5; 482/79

(56) References Cited

U.S. PATENT DOCUMENTS

| | | | | |
|---|---|---|---|---|
| 1,561,516 | A | | 11/1925 | Glowa |
| 2,214,052 | A | | 9/1940 | Good |
| 2,283,595 | A | * | 5/1942 | Banister |
| 2,317,020 | A | * | 4/1943 | Banister |
| 2,810,213 | A | | 10/1957 | Jonas |
| 3,361,427 | A | | 1/1968 | Paves |
| 3,472,508 | A | | 10/1969 | Baker et al. |
| 3,925,915 | A | * | 12/1975 | Colli |
| 4,206,558 | A | | 6/1980 | Bivona |
| 4,247,996 | A | | 2/1981 | Grapin et al. |
| 4,461,102 | A | * | 7/1984 | DeVincentis |
| 4,461,104 | A | * | 7/1984 | Calkin et al. |
| 4,567,678 | A | * | 2/1986 | Morgan et al. |
| 4,727,662 | A | * | 3/1988 | Ilon |
| 4,843,672 | A | * | 7/1989 | Fasse |
| 4,951,938 | A | | 8/1990 | Smith, IV |
| 4,958,445 | A | * | 9/1990 | Brisco |
| 5,135,450 | A | | 8/1992 | Smith, IV |
| 5,713,820 | A | | 2/1998 | Carbone |
| 5,896,684 | A | * | 4/1999 | Lin |
| 5,992,058 | A | * | 11/1999 | Jneid |

FOREIGN PATENT DOCUMENTS

| | | |
|---|---|---|
| GB | 1373202 | 11/1974 |
| GB | 13916670 | 4/1975 |
| GB | 2074009 | 10/1981 |

* cited by examiner

*Primary Examiner*—Ted Kavanaugh
(74) *Attorney, Agent, or Firm*—Richard C. Litman

(57) ABSTRACT

Several embodiments of a therapeutic rocking shoe, provide for the fore and aft reversibility of the shoe relative to the wearer's foot for working different muscle groups of the lower body. Each embodiment has a flat upper or insole surface, with a convex asymmetrically longitudinally curved sole or lower surface. The sole has a greater degree of curvature, i. e., a smaller radius of curvature, at one end than at the other, with the central portion of the sole having an intermediate degree of curvature. This varying curvature produces different effects as a wearer of the shoes rocks forwardly and rearwardly on the shoes, thus exercising various muscle groups in the lower body. The present rocking shoes are easily reversed relative to their longitudinal orientation for the wearer to place either the greater curvature or the lesser curvature of the soles generally beneath the heels of the wearer, as desired.

5 Claims, 9 Drawing Sheets

ROCKING SHOE

REFERENCE TO RELATED PATENT APPLICATION

This application claims the benefit of U.S. Provisional Patent Application Serial No. 60/170,760, filed Dec. 15, 1999.

BACKGROUND OF THE INVENTION

1. Field of the Invention

The present invention relates generally to therapeutic shoes, and more particularly, to low impact exercise shoes designed to stretch and to strengthen foot, leg, and buttocks muscles and tendons. The present invention may be considered in a broader context to be a lower body exercise device, as it is not necessary that the shoes be used in walking or travel. The present shoes have soles with asymmetric curvature in their longitudinal direction (i. e., toe to heel), and are longitudinally reversible to place the greatest curvature beneath either the forward or rearward portion of the foot, as desired.

2. Description of Related Art

Exercise shoes having various shapes and features have been previously constructed for exercise, therapy, and recreation purposes. Some shoes have been developed which have longitudinally convex soles, upon which the wearer may rock forwardly and rearwardly for foot, ankle, and lower leg muscle exercise. These convex sole shoes of the prior art are all unidirectional, i.e., have a specific toe and heel orientation and cannot be reversibly worn. Thus, they provide exercise or flexion of either the anterior or posterior muscle groups, but cannot be reversed to provide muscle exercise for the complementary muscle group.

Accordingly, a need will be seen for an exercise shoe of simple unitary construction that can be used for anterior foot stretches and other exercises and, alternately, reversed for posterior foot flexion exercises. The present rocking shoe invention responds to this need with different embodiments, each having the common feature of a sole with a longitudinally asymmetric convex curvature and longitudinal reversibility, to allow a wearer to position the portion of the sole having the greatest curvature beneath either the forward or the rearward portion of the foot, as desired, to exercise and strengthen corresponding muscle groups.

A discussion of the related art of which the present inventor is aware, and its differences and distinctions in comparison to the present invention, is provided below.

U.S. Pat. No. 1,561,516 issued on Nov. 17, 1925 to Anton Glowa, titled "Footgear," describes devices for wearing over the shoes, for lengthening the stride of the wearer during walking. The devices each include a pair of generally laterally disposed convex arcuate rods therebeneath, upon which the wearer rocks or rolls the foot forwardly while walking. An additional spring loaded plunger is located just behind the heel, which absorbs some of the energy when the heel contacts the underlying surface during walking, and returns that energy to rock the foot forward for the next step. The Glowa appliance does not have a longitudinally asymmetric sole to provide variable radii of rotation during use, as provided by the present rocking shoe invention, and moreover cannot be reversibly worn on the shoe, due to the rearwardly disposed plunger.

U.S. Pat. No. 2,214,052 issued on Sep. 10, 1940 to Harry L. Good, titled "Exercising Boot," describes a device for application over an existing shoe, for lower body exercise.

The Good boot generally comprises a pair of laterally disposed vertical plates extending beneath a flat sole portion. A compound convex heel plate is provided and the forward ends of the lateral plates have convex curvature, but the central portions of the lower plate edges are straight, rather than providing continuous curvature beneath the foot, as in the present invention. Moreover, the shape of the Good boot and particularly its heel closure and attachment straps, precludes longitudinal reversal of the device. In any event, Good does not disclose any difference between the curvature of the heel and toe portions of his boot, unlike the longitudinally asymmetric and continuous curvature of the present rocking shoe.

U.S. Pat. No. 2,810,213 issued on Oct. 22, 1957 to Jerry J. Jonas, titled "Footgear," describes footwear having an arcuate convex curved sole with a uniform radius of curvature. An alternate embodiment provides two spaced apart and generally vertically disposed plates having arcuate lower edges, rather than a single sole plate. The Jonas footgear differs essentially from the present rocking shoe, in that (1) the sole curvature is of constant and uniform radius and symmetrical from heel to toe, whereas the sole curvature of the present shoe is asymmetric, with a smaller radius at one end than the other; and (2) Jonas provides separate attachment straps configured particularly to fit around the forward portion of the ankle and over the toes, thus precluding fore and aft reversibility, as provided by the present invention. Due to the symmetrical shape of the sole of the Jonas footgear, Jonas has no motivation to provide reversibility, as the same effect would be attained regardless of the longitudinal orientation of the shoe, due to the symmetrical configuration of the sole.

U.S. Pat. No. 3,361,427 issued on Jan. 2, 1968 to Nathan L. Paves, titled "Exercise Rocker," describes a single platform for a person to stand upon with both feet, unlike the separate shoes of the present invention. The Paves platform has a generally I-shaped structure therebeneath, with the opposed flanges of the I disposed to the left and right ends and the web of the I extending laterally therebetween. The center portion of the web is parallel to the platform upper surface, with the ends tapering to the narrower flanges. The flanges also taper at their forward and aft ends, in a like manner. No curvature is provided in this supporting structure; all of the defining edges are straight lines. Moreover, the Paves platform cannot be reversed between fore and aft directions, due to the heel stops provided at the rearward edge.

U.S. Pat. No. 3,472,508 issued on Oct. 14, 1969 to Richard E. Baker et al., titled "Exercising Device For Rocking The Foot To Exercise The Lower Leg," describes a shoe having a flat sole with a relatively small radius convex curved toe portion. The upper or insole area has a generally sinusoidal curvature, with the forward or toe end being about five times the height of the heel portion, i. e., the toes are elevated considerably above the heel when the Baker et al. shoe is worn. The attachment straps and a lateral heel retaining pin cannot be rearranged to provide for reversal of the Baker et al. shoe, whereas the present rocking shoe is longitudinally reversible to provide exercise for a wider range of muscle groups than the Baker et al. shoe is capable of providing.

U.S. Pat. No. 4,206,558 issued on Jun. 10, 1980 to Vincent J. Bivona, titled "Exercise Shoes For Simulated Jogging," describes a shoe having a longitudinally convex curved sole and flat insole. However, the Bivona shoe is longitudinally symmetrical, having the same curvature forwardly and rearwardly of the center, unlike the present rocking shoe invention. The greatest degree of curvature, i. e., smallest radius, is in the center of the sole of the Bivona shoe, whereas it is disposed to one end of the present rocking shoe invention. While Bivona provides a longitudinally symmetrical sole, he positions the attachment strap closer to one end than the other, thus precluding longitudinal reversal of his shoe. The longitudinally symmetrical sole of the Bivona shoe does not provide any motivation for longitudinal reversal, in any event.

U.S. Pat. No. 4,247,996 issued on Feb. 3, 1981 to Pierre A. Grapin et al., titled "Walking Aid Device," describes a shoe intended to increase the length of the stride. The sole comprises a longitudinally arcuately curved plate, with a flat insole surface extending across the inner portion of the arc. The foot attachment straps are asymmetrically arranged, and include a single central heel strap which attaches to a collar which passes around the ankle. Grapin et al. do not disclose any means of rearranging their straps to allow longitudinal reversal of their walking aid, nor do they have any motivation to do so, due to the symmetrical configuration of the arcuate sole. The Grapin et al. device is more closely related to the footgear of the Jonas '213 U.S. Patent discussed further above, than to the present invention.

U.S. Pat. No. 4,951,938 issued on Aug. 28, 1990 to Christopher J. B. Smith, IV, titled "Exercise Shoe," describes a shoe having an longitudinally convex sole plate with a pair of spaced apart plates extending upwardly therefrom. The plates in turn support a pair of longitudinally spaced apart foot supports, with the two foot supports being angled to define a shallow V-shape. The heel support is positioned somewhat higher than the support for the ball of the foot, with the plane of the heel support intersecting the plane of the forward support near the forward end of the forward support. Thus, the entire shoe is longitudinally asymmetric, and cannot be reversed fore and aft to alter the muscle groups exercised while wearing the shoe, as provided by the present rocking shoe invention.

U.S. Pat. No. 5,135,450 issued on Aug. 4, 1992 to Christopher J. B. Smith, IV, titled "Exercise Shoe With Limited Range Of Rocking Motion," describes a shoe closely resembling that of the '938 U.S. patent to the same inventor, described above. The shoe of the '450 U.S. patent includes a pair of side plates which are removably attached to each side of the shoe structure. The side plates include rollers extending therebetween at each end thereof, with the rearward roller being adjustably installable between a series of holes in the rear portions of the side plates. The rollers pass below the forward and rearward ends of the semicircular sole plate of the shoe, and serve to limit the rocking motion which may be achieved by the Smith, IV shoe. The remainder of the shoe is essentially like that disclosed in the '938 U.S. patent described above, with the same limitations relating to the lack of fore and aft reversibility.

U.S. Pat. No. 5,713,820 issued on Feb. 3, 1998 to Giuseppe Carbone, titled "Equipment For Carrying Out Anterior And Posterior Foot And Lower Limbs Flexion Exercises," describes various embodiments of a shoe having a longitudinally curved convex sole. The means for securing the shoe to the foot is not reversible, as it includes a strap which wraps about the back of the heel. Carbone does not provide any means for changing the positioning of the straps. Rather, he provides means for interchanging the curved portions beneath the flat insole to which the straps attach, in order to change the curvature as desired.

British Patent Publication No. 1,373,202 published on Nov. 6, 1974 to Alexander M. Panaretos, titled "A Base For Articles Of Footwear," describes a device having a relatively high heel portion and lower forward portion, with the sole having a variable radius arcuate curve thereto from toe to heel. The device utilizes essentially the same principles as the footgear of the Jonas '213 and Grapin et al. '996 U.S. patents discussed further above, but utilizes a larger radius curvature across the majority of the sole, relative to the heel and toe curvatures. Panaretos states that the base is to be equipped with an upper portion (shoe, sandal straps, etc.) for securing the device to the foot, but he is silent regarding any means for reversing the device relative to the heel and toe of the wearer.

British Patent Publication No. 1,391,667 published on Apr. 23, 1975 to Hideru Nakamoto, titled "Footwear For Foot Massage," describes a shoe having a single or double wedge shaped lower portion, for either elevating the forward portion of the foot or for rocking about the raised fulcrum in the center of the double wedge embodiment. Each embodiment includes an upper portion which wraps over the forward portion of the foot, with a heel strap extending rearwardly from the upper portion wrap. This foot retaining assembly cannot be reversed relative to the sole portion. Thus, the Nakamoto shoe is restricted to only one longitudinal orientation relative to the wearer's foot, unlike the longitudinally reversible shoe of the present invention.

Finally, British Patent Publication No. 2,074,009 A published on Oct. 28, 1981 to Lee D. Taicher, titled "Shoe Bottom," describes a shoe having a relatively thick sole with a convex longitudinal curvature thereto. The general configuration more closely resembles that of the shoe of the Bivona '558 U.S. Patent, discussed further above, than the present invention. While the arcuate curvature of the bottom of the sole of the Taicher shoe appears to be longitudinally symmetrical (excepting one embodiment with a small depending heel), the Taicher shoe cannot be reversed longitudinally due to its platform, which closely conforms to the shape of the human foot. In view of the apparent longitudinal symmetrical configuration of the Taicher shoe, there is no motivation to reverse the orientation of his shoe from front to rear in any event.

None of the above inventions and patents, taken either singly or in combination, is seen to describe the instant invention as claimed.

SUMMARY OF THE INVENTION

The present invention is a therapeutic shoe which may be made and used with or without foot straps, and with or without a non-skid surface coating for traction. The shoe has an elongated flat top surface that is preferably rectangular in plan, but may also have an oval or other shape conforming to the foot platform if so desired. The bottom surface of the shoe is longitudinally convex with a continuously changing radius of curvature. The center of mass of the shoe is closer to the second end than to the opposite first end and is located at a distance from the first end approximately three-fifths of the length of the top surface.

The foot straps may be made from plastic, leather, either natural or synthetic fabric, or an elastic material such as a plastic/rubber composite, and linked to the shoe and to each other by snaps, mating hook and loop material, etc. so that they are easily removable from the shoe. The shoe may be reversed 180° on either foot. The alternate orientation enables the user to stretch and strengthen different muscles of the leg. In one orientation, the heel of the foot is just aft of the center of mass of the shoe. In this manner, the user can lift his or her toes upward and rock his or her heel backward from the center of mass, which serves as a fulcrum, to contract and strengthen the anterior leg muscles. In another orientation, the shoe is turned 180° and the straps (if used) repositioned as required such that the ball of the foot is generally over the center of mass. In this manner, the user can press his or her toes downwardly and rock the shoe forward past the center of mass near the fulcrum, to contract and strengthen the posterior leg muscles, while stretching the anterior leg muscles.

The exercise movements with the present shoe are facilitated by the fact that the bottom surface has at least three sections, each having a different average degree of curvature. The three sections include a central section having a medium degree of curvature to allow a complete rocking motion for the purpose of stretching and strengthening the leg muscle without so great a curvature such that the shoe would be significantly unstable, and a strapless shoe would thus not be possible. A first end portion has a relatively low average degree of curvature, and extends from about the first end to the central section. (The extreme end may be somewhat blunted, for greater strength.) The relatively long radius curvature is important so that the shoe can rest in a stable, substantially horizontal position when a person mounts the shoe, with or without the straps. This shallow first curvature is also critical in that it provides a gradual transition from the sharper central curvature, and thus provides a smooth "ride" for the user. A second section has a relatively high degree of curvature, and extends from the central portion to the second end of the shoe.

Accordingly, it is a principal object of the invention to provide a rocking shoe of unitary construction which may be used to stretch and to strengthen the muscles and tendons of the foot, ankle, and legs.

It is a further object of the invention to provide a rocking shoe with a first end portion and an opposite second end portion, each having a bottom surface with different degree of curvature which enables the user to work different muscle ranges.

It is another object of the invention to provide a rocking shoe which has a flat upper surface such that the shoe may be reversed longitudinally relative to the foot of the wearer to provide two alternate ranges of flexion for the foot.

An additional object of the invention is to provide a rocking shoe in which foot retaining straps, if provided, may be reversed relative to the first and second ends of the shoe for reversal of the orientation of the shoe on the wearer's foot as desired.

Still another object of the invention is to provide a rocking shoe in which at least one embodiment does not require straps or other means to secure the shoe to the foot of the user, for stationary exercises.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of a rocking shoe having a longitudinally arcuate convex sole, for producing a longitudinal rocking action when worn. The curvature of the sole varies in radius from one end of the shoe to the other, to provide varying effects. The present rocking shoe is also longitudinally reversible on the foot, thereby providing further variations in the effect when worn.

Figure 1A:
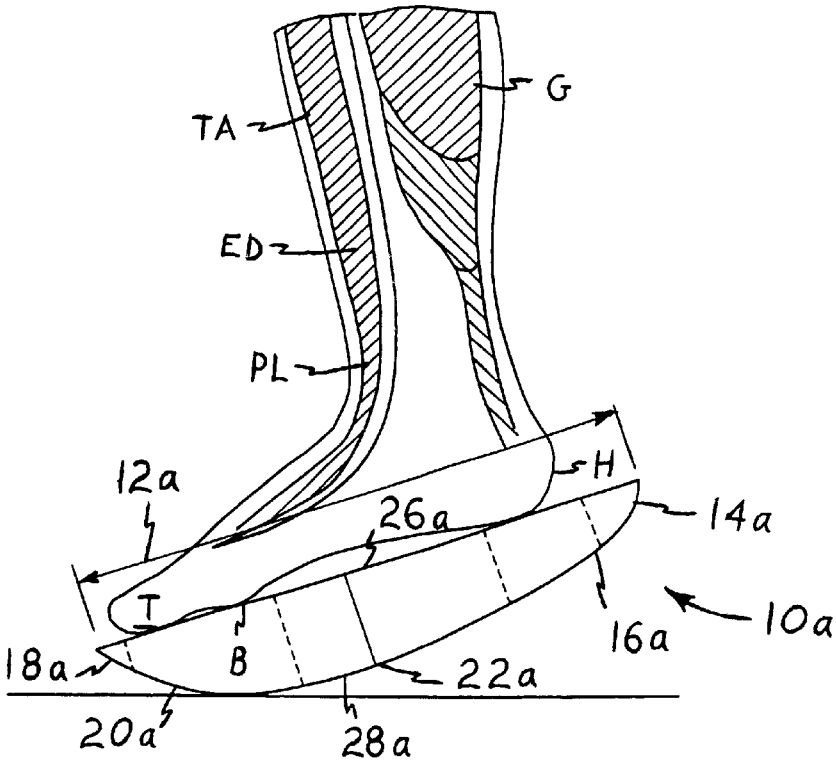
FIG. 1A is an environmental side elevation view of a first embodiment of the present rocking shoe without foot straps, showing the heel positioned at the first end of the shoe.
Figure 1B:
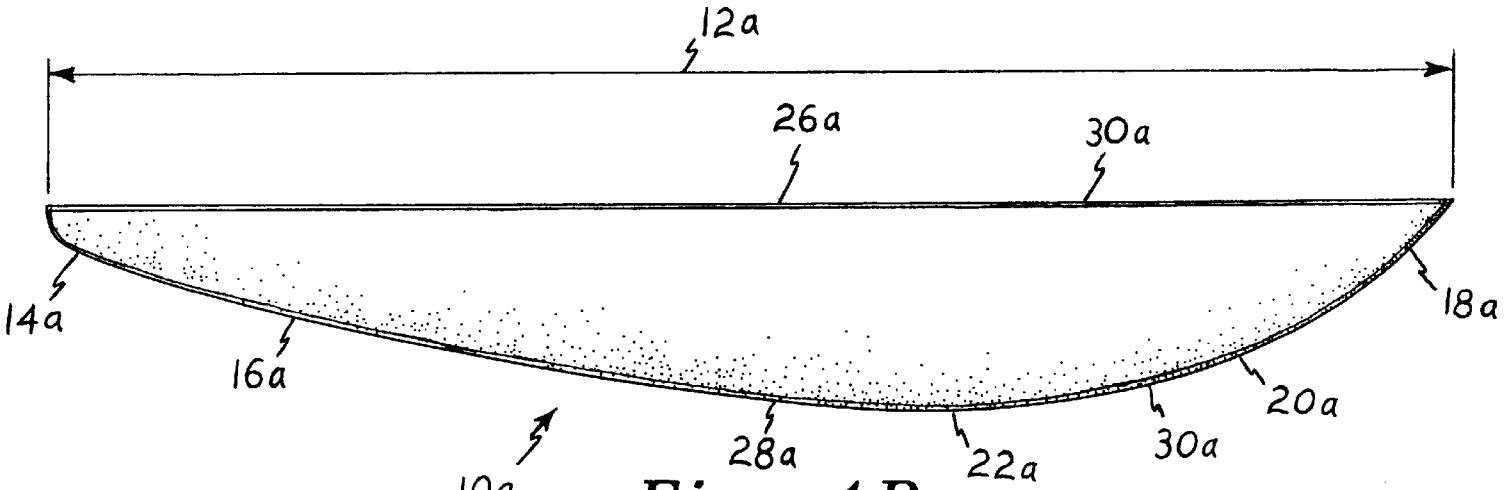
FIG. 1B is a side elevation view of the shoe of FIG. 1A, with the first and second end orientation reversed.
Figure 1C:
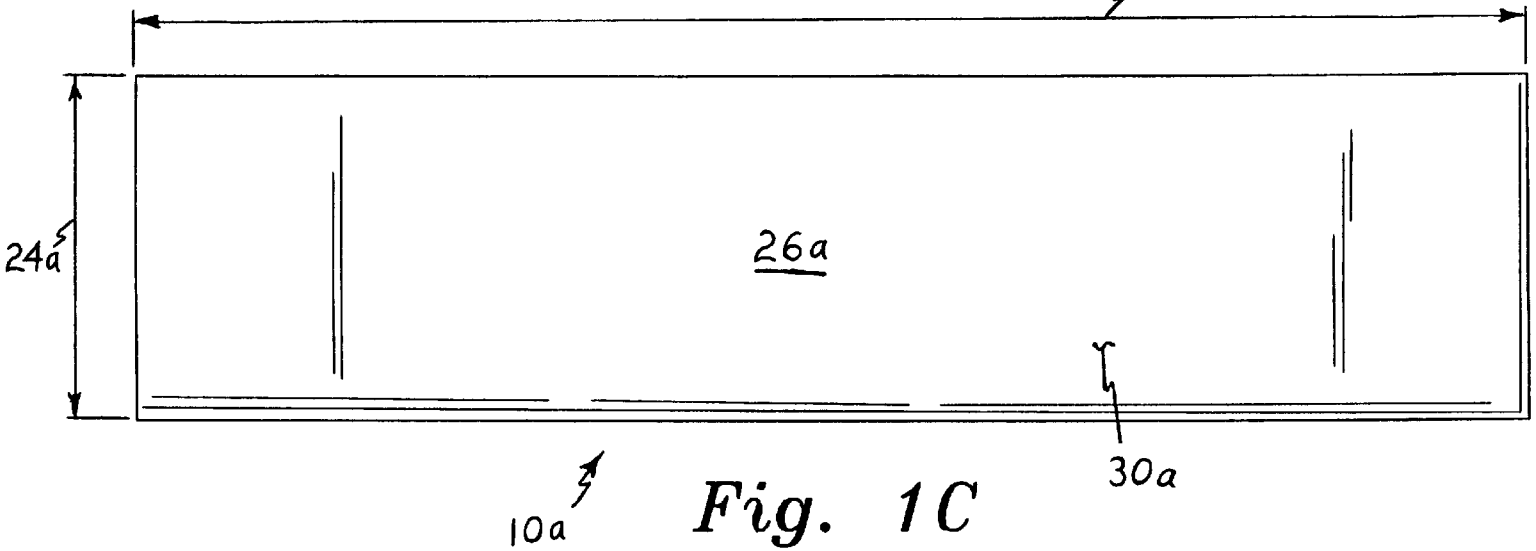
FIG. 1C is a top plan view of the shoe of FIGS. 1A and 1B.

FIGS. 1A through 1C illustrate first and second side elevation and top plan views of a first embodiment of the present therapeutic rocking shoe, designated as shoe 10*a*. The shoe 10*a* is preferably formed of a solid, monolithic mass of impervious material (e. g., cast or molded plastic, a block of wood, etc.) for economy and durability. The shoe 10*a* has a length 12*a* extending from the tip 14*a* of the first end 16*a* to the tip 18*a* of the second end 20*a*, with an intermediate portion 22*a* extending between the first and second end portions 16*a* and 20*a*. (The first tip end 14*a*, with its relatively thin section due to the shallow curvature and slope of this portion of the shoe, may be rounded as shown in FIGS. 1A and 1B to provide sufficient thickness for strength and resistance to breakage as required.) The length 12*a* and width 24*a* are sufficient to encompass the sole of the foot F of the user; obviously, the present rocking shoe may be constructed in different lengths and widths to conform to different foot sizes, as in the case of conventional footwear.

The upper sole surface 26*a* of the shoe 10*a* is flat and is longitudinally and laterally symmetrical, as shown clearly in FIG. 1C of the drawings. In fact, it will be noted that it is not possible to determine which end of the shoe 10*a* has the greater degree of undersole curvature, from a top plan view of the shoe. This enables the shoe 10*a* (and other embodiments) to be reversed longitudinally relative to the heel H and toes T of the wearer's foot F, thus selectively placing either the first end portion 16*a*, with its shallow curvature and large radius, or the second end portion 20*a*, with its relatively greater degree of curvature and smaller radius, beneath either the heel area H or the forward area (ball B or toes T of the foot F) of the wearer, as desired.

The bottom or outer sole 28*a* has a continuous longitudinal convex curvature from the first end portion 16*a* to the opposite second end portion 20*a*, as shown clearly in FIGS. 1A and 1B. This curvature, varying smoothly and blending continuously from the large radius of the first end portion 16*a*, across the intermediate radius of the intermediate portion 22*a*, to the smaller radius of the second end portion 20*a*, provides a differentially curved arcuate lower sole 28*a* which provides various benefits in the exercise of various muscle groups of the lower body and legs, depending upon the longitudinal orientation of the shoe 10*a* relative to the foot F of the user. Both the flat upper sole surface 26*a* and opposite curved lower sole 28*a* may have a coating 30*a* with a high coefficient of friction (e. g., conventional rubberized coating, roughened surface, etc.) for better traction.

It will be noted that the therapeutic rocking shoe 10*a* of FIGS. 1A through 1C, is devoid of any means for securing the shoe 10*a* positively to the foot F of the wearer or user. The shoe 10*a* is not intended to be worn for walking or travel by foot; rather, it is purely an exercise device, providing stretching and strengthening of the various muscle groups of the lower body of the user, particularly the anterior and posterior muscle groups in the lower legs. This is the primary reason for the high coefficient of friction surface material 30*a* noted above.

Figure 2A:
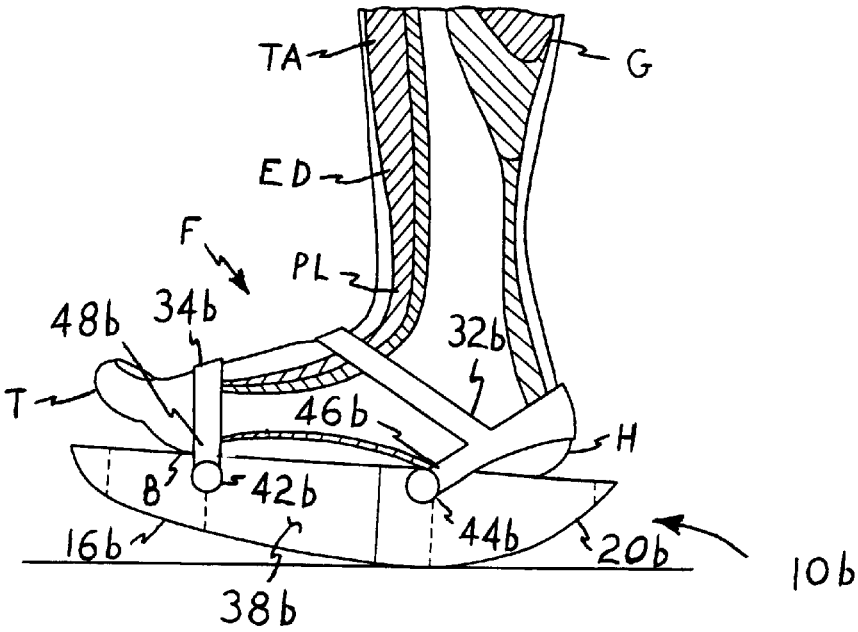
FIG. 2A is an environmental side elevation view of a second embodiment of the present rocking shoe with foot retaining straps, showing the heel positioned at the second end of the shoe.
Figure 2B:
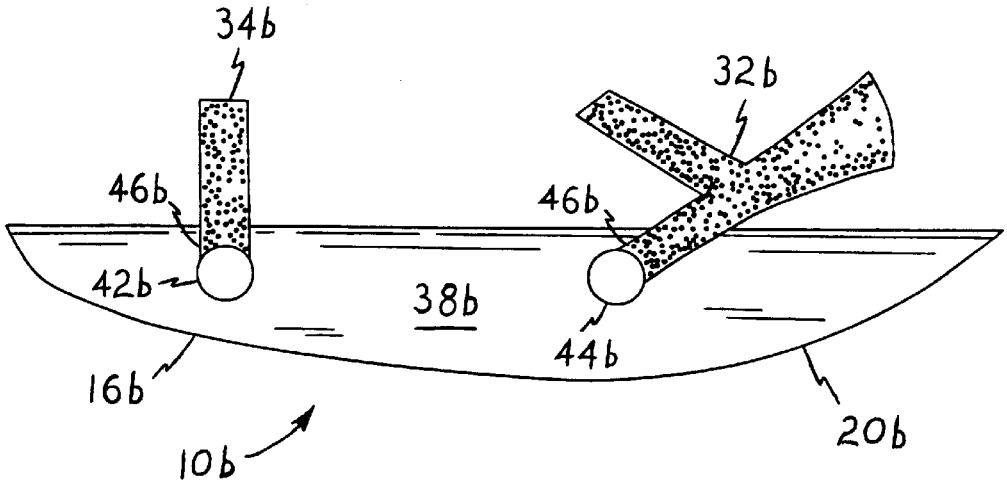
FIG. 2B is a side elevation view of the shoe of FIG. 2A.
Figure 2C:
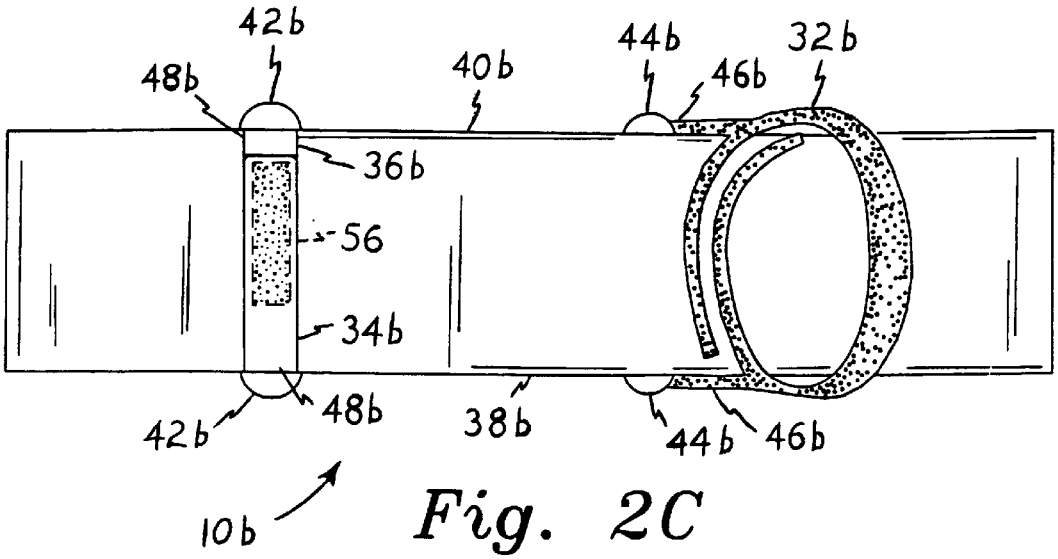
FIG. 2C is a top plan view of the rocking shoe embodiment of FIGS. 2A and 2B.

However, various means of positively attaching and securing various shoe embodiments to the foot of the wearer, may be provided as desired. In FIGS. 2A through 2C, a therapeutic rocking shoe 10*b* includes a series of straps for passing about the foot F of the wearer, to hold the shoe 10*b* positively to the wearer's foot F. Excepting the straps and their attachment means, the shoe 10*b* is essentially identical to the structure of the shoe 10*a* of FIGS. 1A through 1C, discussed above.

The straps comprise a combination heel and ankle strap 32*b* and a pair of opposite toe or instep straps 34*b*, 36*b*. While the straps 32*b* through 36*b* are configured to secure specific parts of the foot F to the underlying shoe 10*b* it should be noted that these straps are not permanently attached to corresponding portions of the shoe 10*b*. Rather, they may be interchangeably installed to the first or second portions 16*b* and 20*b* of the shoe 10*b*, as desired, in order to reverse the longitudinal orientation of the shoe 10*b* relative to the foot F of the user, as desired.

Figure 6:
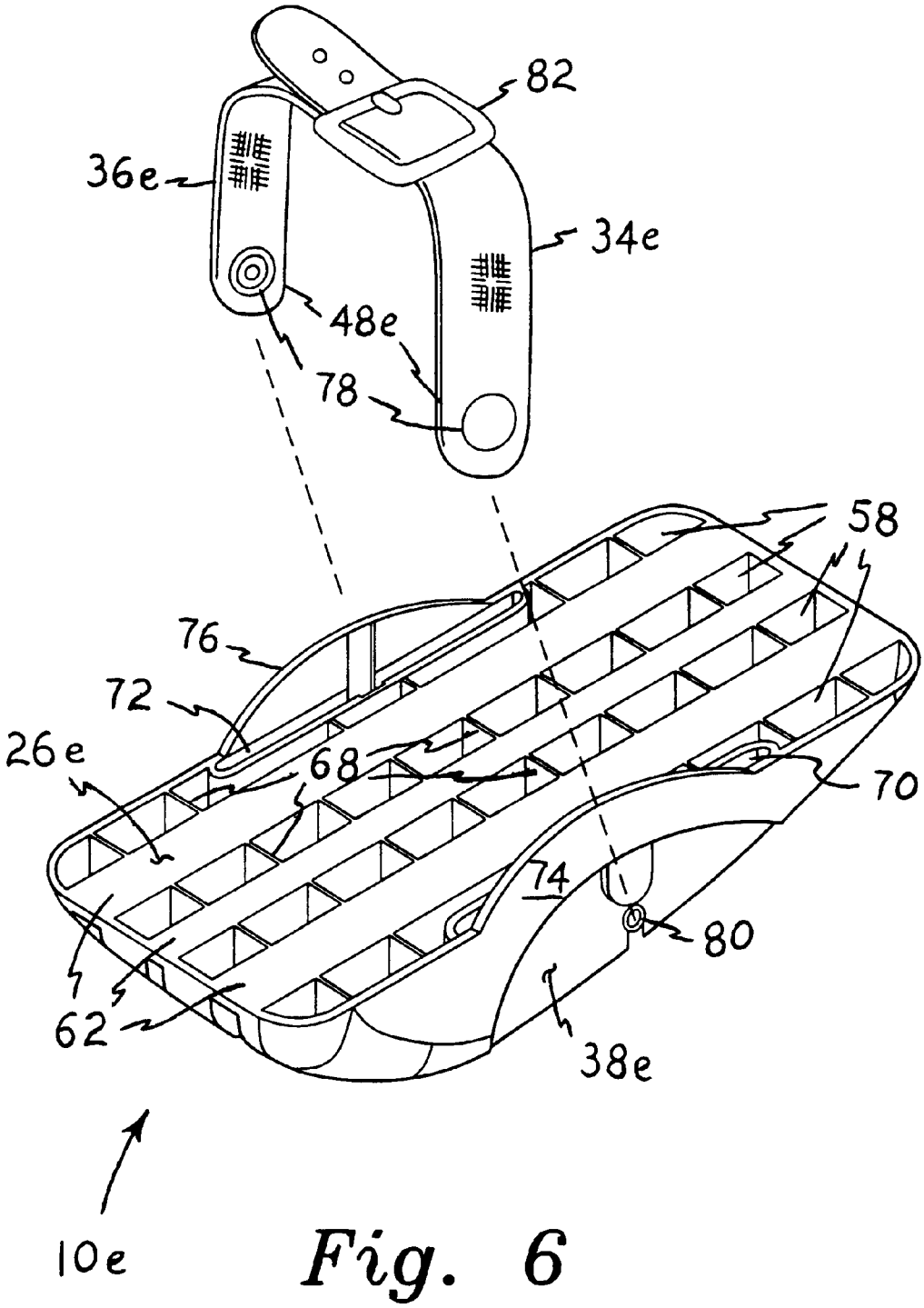
FIG. 6 is an exploded perspective view of a fifth embodiment of the present rocking shoe invention, illustrating an alternative structure for the shoe and a detachable strap therefor.

The shoe 10*b* includes a first side 38*b* and an opposite second side 40*b*, each having first strap attachment means 42*b* and second strap attachment means 44*b*, respectively located along the first end portion 16*b* and second end portion 20*b* of each side 38*b* and 40*b*. These strap attachment points 42*b* and 44*b* may comprise conventional male side snap portions secured to the sides 38*b* and 40*b* of the shoe 10*b*, with the attachment ends 46*b* and 48*b* of the respective straps 32*b* through 36*b* having mating female strap snap portions thereon; an example of such is illustrated in the embodiment of FIG. 6 of the drawings.

As all of the first and second side snap attachment points 42*b*, 44*b* are identical to one another, with the mating strap snap attachments also being identical to one another, it will be seen that any of the strap ends 46*b*, 48*b* may be attached to any of the side strap attachment points 42*b*, 44*b* as desired. This enables the user of the present therapeutic rocking shoe 10*b* embodiment to interchange the heel and ankle strap assembly 32*b* from the second side strap attachment points 44*b* to the first attachment points 42*b*, and the toe straps 34*b*, 36*b* from the first side strap attachment points 42*b* to the second attachment points 44*b*, as desired. This enables the rocking shoe 10*b* to be positively secured to the foot of the user in either longitudinal orientation desired (i. e., the first end 16*b* disposed beneath the ball B of the foot F, as shown in FIG. 2A, or reversed) depending upon the type of exercise desired by the user, without requiring a completely different shoe.

Figure 3:
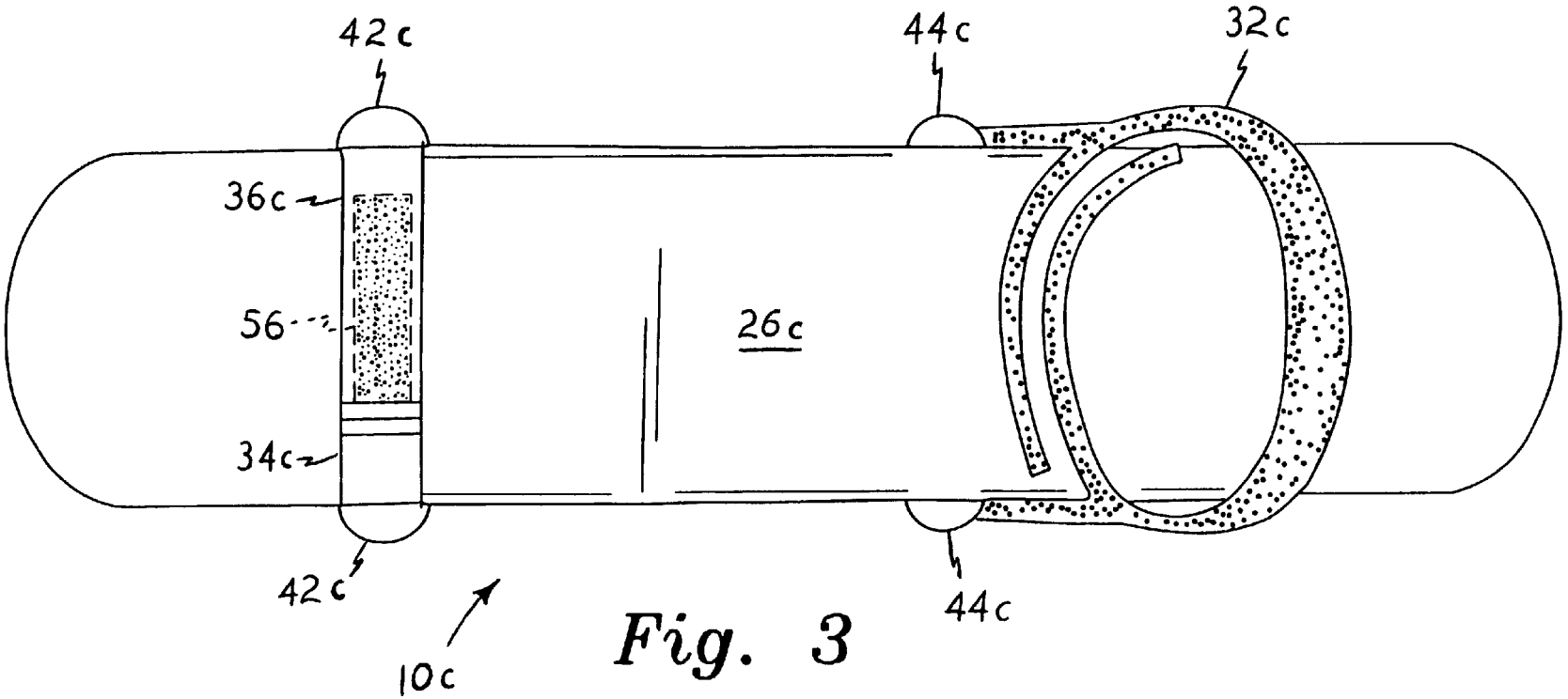
FIG. 3 is a top plan view of a third embodiment of the present rocking shoe similar to the second embodiment of FIGS. 2A through 2C, but having rounded first and second ends.

FIG. 3 illustrates a top plan view of another embodiment of the present therapeutic rocking shoe, similar to the embodiment of FIGS. 2A through 2C. The rocking shoe 10*c* of FIG. 3 will be seen to be of the same general configuration as the rocking shoe 10*b* of FIGS. 2A through 2C, with the exception of the shape of the platform of the upper or insole 26*c*. Rather than having the rectangular plans of the insoles 26*a* and 26*b* respectively of the rocking shoes 10*a*and 10*b*, the ends of the shoe structure 10*c* have been rounded to provide a generally oval shape for the insole area 26*c*. Otherwise, the shoe 10*c* is essentially the same as the shoe 10*b* of FIGS. 2A through 2C, having a heel and ankle strap assembly 32*c* and toe or instep strap pair 34*c* and 36*c*, with the straps 32*c* through 36*c* being removably and interchangeably securable to either set of attachment points 42*c* or 44*c*, as desired. It will be seen that this oval platform may be adapted to any of the rocking shoe configurations of the present invention, as desired, and that this modification of the ends of the shoe 10*c* (or other shoes) still retains the longitudinally symmetrical shape of the structure.

Figure 4A:
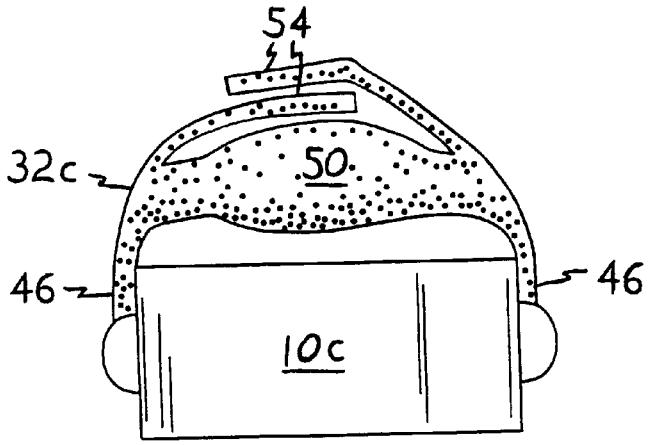
FIG. 4A is an end elevation view of the embodiment of FIG. 3, showing the heel and ankle retaining strap configuration for that embodiment and for the embodiment of FIGS. 2A through 2C.
Figure 4B:
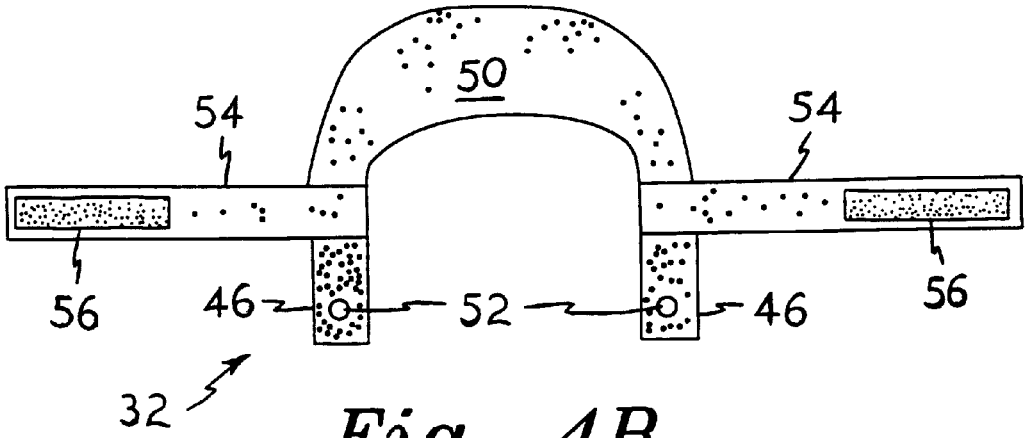
FIG. 4B is a flat plan view of the heel and ankle securing strap assembly of the shoe of FIGS. 2A through 3.
Figure 4C:
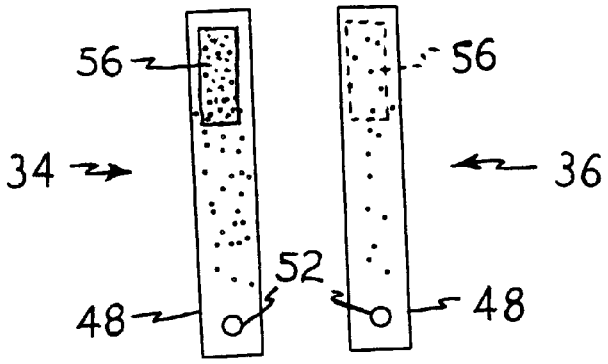
FIG. 4C is a flat plan view of the toe or instep retaining straps of the shoe of FIGS. 2A through 3.

FIGS. 4A through 4C illustrate the various strap configurations for the present rocking shoe, e. g., shoes 10*b* and 10*c* discussed above. FIG. 4A illustrates one end of the rocking shoe 10*c* of FIG. 3, with the heel and ankle strap assembly 32*c* secured thereto. FIGS. 4B and 4C illustrate flat plan views of the heel and ankle strap assembly 32 and the two toe or instep strap portions 34, 36. These straps 32 through 36 of FIGS. 4B and 4C do not include an alphabetic subcharacter, as they are the same as the respective straps 32*a*, 32*b* through 36*a*, 36*b* and are adaptable for use with either of the rocking shoes 10*b* and 10*c* of FIGS. 2A through 3, as desired.

The heel and ankle strap assembly 32 comprises a generally U-shaped flat pattern with a relatively wide heel portion 50 which wraps about the back of the heel of the wearer, with the two opposite shoe attachment end portions 46 extending from the heel portion 50. Each of the attachment ends 46, 48 of the various strap portions 32 through 36 includes some form of shoe attachment means 52 disposed thereon, e. g., a mating snap to fit snaps provided at the first and second strap attachment points 42*b*, 44*b* or 42*c*, 44*c* of the shoes 10*b* and 10*c*, or other cooperating attachment means as desired. The heel strap assembly 32 also includes opposite laterally extending ankle wrap straps 54, which extend from each or the two end strap portions 46 above the attachment fittings 50. These two ankle straps 54 serve much the same purpose as the mating toe strap portions 34, 36, in that they wrap over or around a portion of the foot to fasten the shoe securely to the foot of the wearer, as shown in FIG. 2A. The various mating strap portions 34, 36 and 54 include some mating attachment means disposed upon opposite strap portions or ends, e.g., mating hook and loop material 56 (e. g., Velcro®), for fastening the respective strap portions securely over and about the wearer's foot, generally as shown in FIG. 2A of the drawings. Other means, e. g. snaps, buckles, etc., may be provided as desired.

Figure 5A:
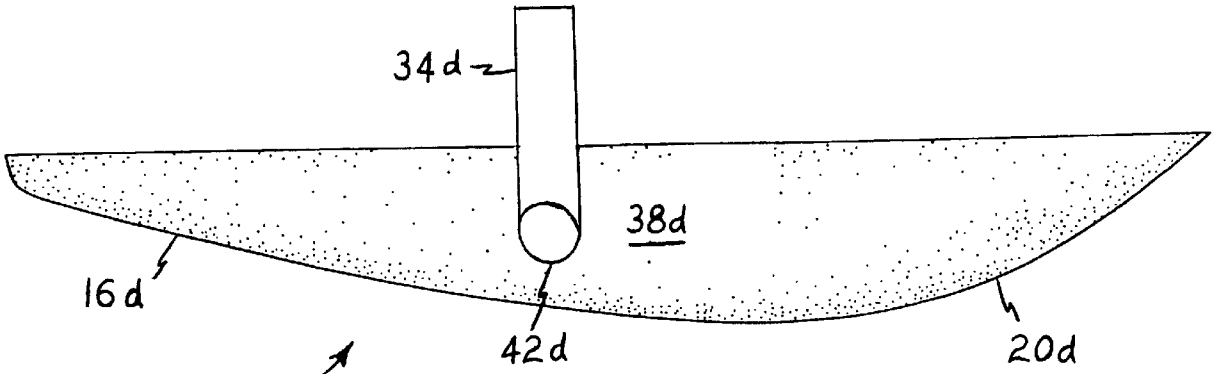
FIG. 5A is a side elevation view of a fourth embodiment of the present rocking shoe, having only a single generally centrally located foot retaining strap.
Figure 5B:
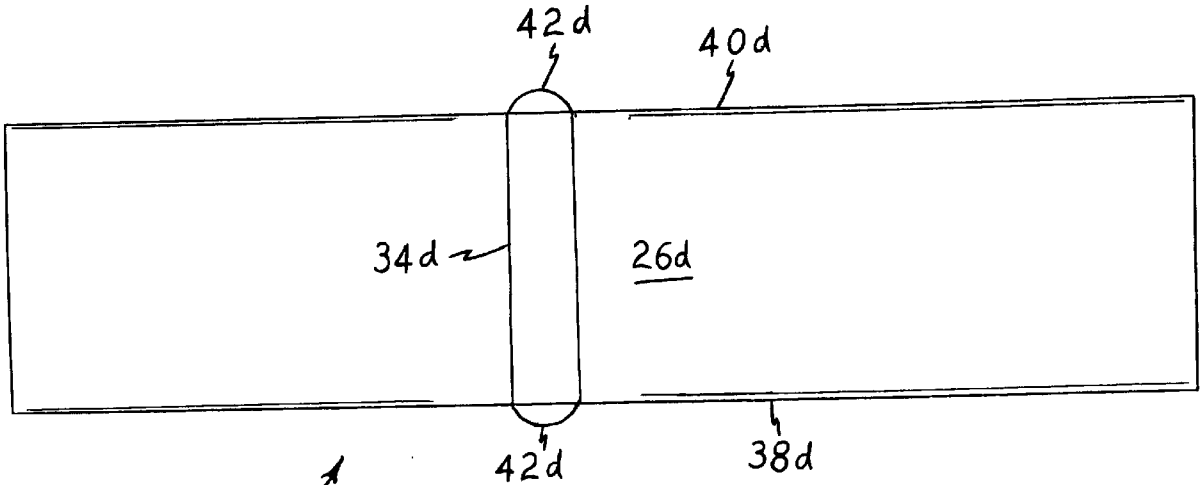
FIG. 5B is a top plan view of the rocking shoe embodiment of FIG. 5A.

The present rocking shoe provides further alternative means for longitudinally reversibly wearing the device, as desired. FIGS. 5A and 5B respectively illustrate first side elevation and top plan views of a rocking shoe embodiment 10*d*, having generally medially disposed first strap attachment means 42*d* upon each side 38*d* and 40*d* thereof. The strap means 34*d* may comprise a single strap (perhaps with some elasticity, for different foot sizes) which extends across the upper or insole surface 26*d* of the shoe 10*d* to connect the two strap attachment points 42*d* to one another, or may comprise two separate strap portions, each of which include some means of removably securing the two portions together, as in the case of the toe or instep straps 34*b*, 36*b* of the shoe 10*b*, etc. This configuration provides for ease of longitudinal reversibility of the shoe 10*d*, allowing the wearer to quickly and easily reverse the orientation of the shoe to place either the first or second end portion 16*d* or 20*d* beneath either the heel area or forward portion of the foot, as desired.

Figure 7:
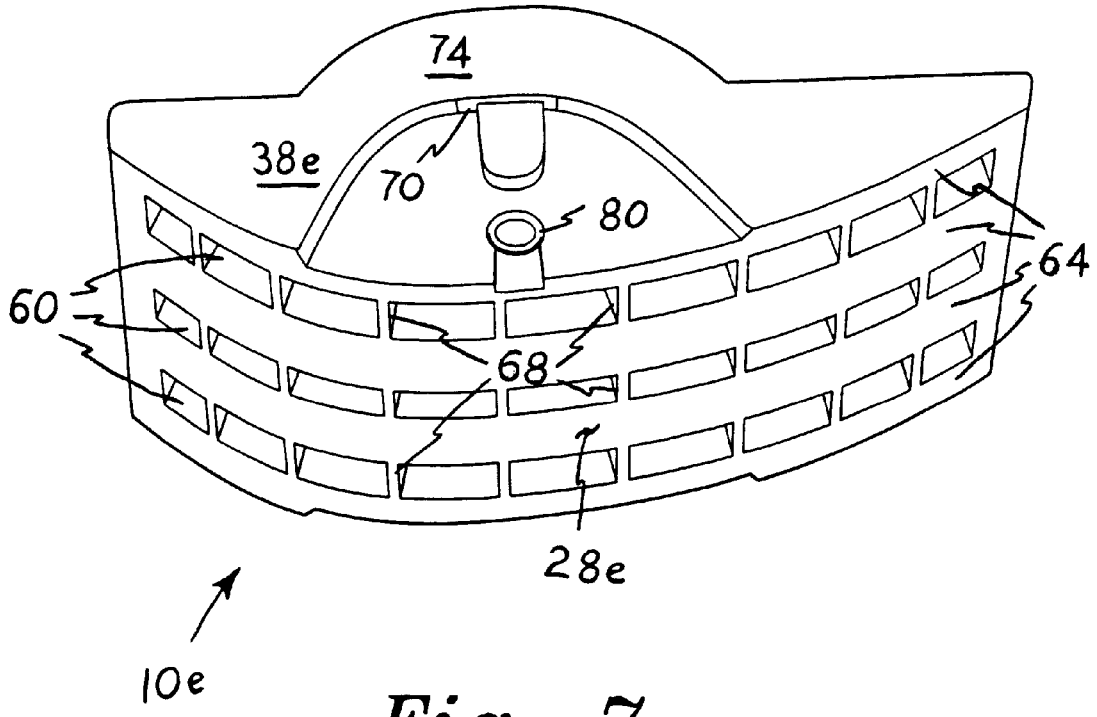
FIG. 7 is a bottom perspective view of the rocking shoe of FIG. 6.
Figure 8:
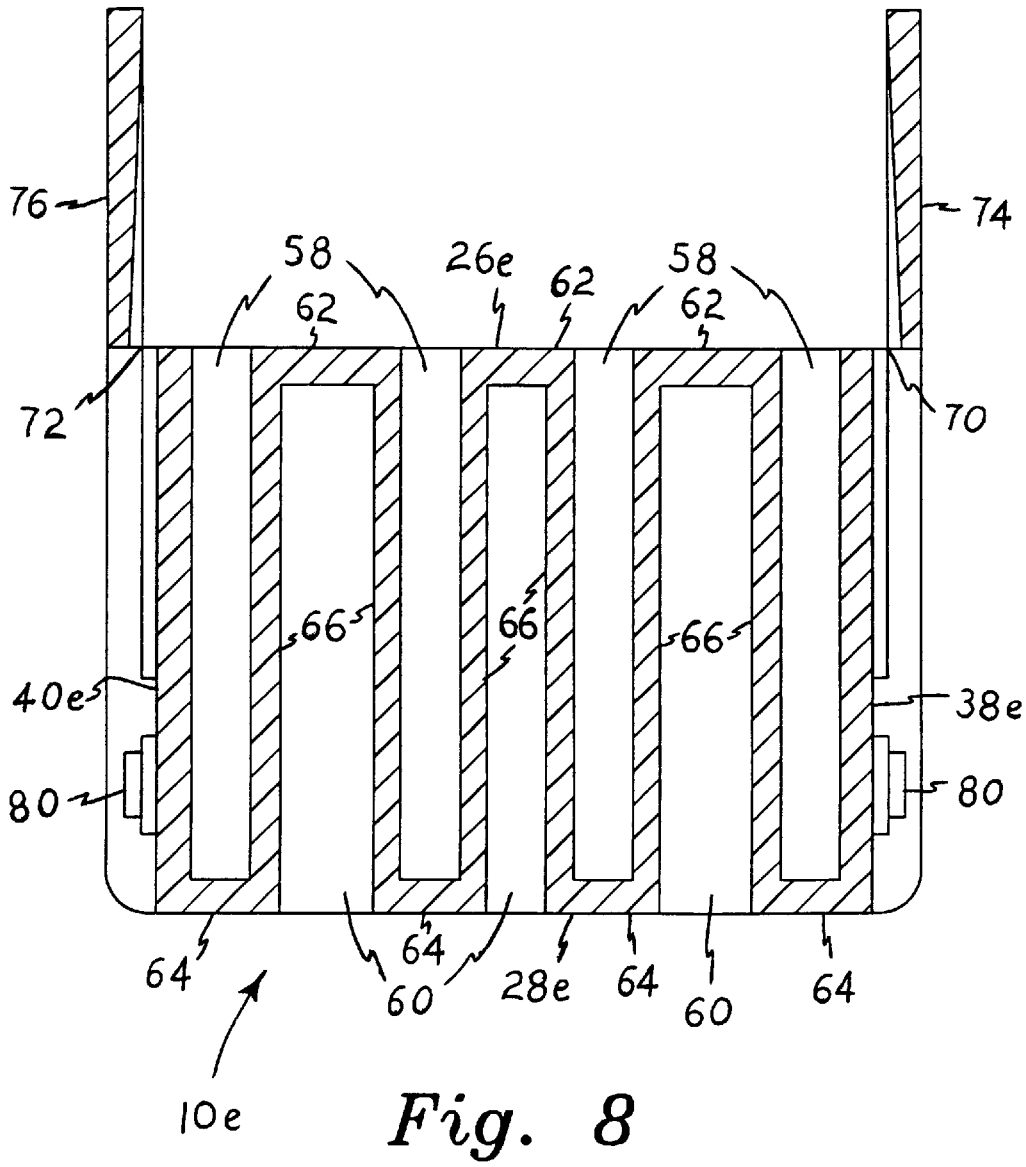
FIG. 8 is an elevation view in section of the rocking shoe of FIGS. 6 and 7, showing its internal configuration.

FIGS. 6 through 8 respectively illustrate top and bottom perspective views and a sectional elevation. view of yet another embodiment of the present rocking shoe, designated as rocking shoe 10*e*. The shoe 10*e* has the same basic configuration as the other rocking shoes of FIGS. 1A through 5B, particularly the shoe 10*d* of FIGS. 5A and 5B, with its generally longitudinally symmetrical retaining strap location. However, rather than being formed of a solid mass of material, the shoe 10*e* is cast or molded of a plastic material, with a series of longitudinal channels formed therein.

The channels are alternatingly disposed from the upper sole or surface 26*e* and opposite lower sole or surface 28*e*, comprising a series of upper channels 58 and lower channels 60, defined by their respective upper and lower openings and opposite upper and lower closures 62 and 64, respectively forming the upper and lower surfaces 26*e* and 28*e* of the shoe 10*e*. These channels 58 and 60 extend essentially the entire length of the shoe 10*e*, and are separated by a series of longitudinal webs 66 extending the length and depth of the shoe 10*e*. A further series of lateral webs 68 extends across each channel 58 and 60, to provide additional rigidity and strength for the shoe 10*e*. This configuration provides a very sturdy structure, yet reduces the mass of the structure considerably to provide a light weight shoe 10*e*.

The shoe 10*e* has a slot 70, 72 formed along each side 38*e* and 40*e* thereof, defined by the respective sides and an arcuate panel 74, 76 extending upwardly from each side. These slots 70, 72 serve to capture the ends 48*e* of the strap portions 34*e* and 36*e* (Nylon or other synthetic fabric, etc.), which are removably attachable to the shoe 10*e*. Each strap end 48*e* includes a female or external snap component 78 which removably and interchangeably attaches to either of the cooperating internal or male snap components 80 disposed upon each side 38*e* and 40*e* of the shoe 10*e*. The strap portions 34*e*, 36*e* may include cooperating buckle attachment means 82, or other suitable conventional connection means (e. g., side latch buckles or clasps, hook and loop material, buttons, snaps, etc.) as desired.

The shoe 10*e* is worn and used in the same manner as that of the other shoe embodiments 10*a* through 10*d* described further above.

In the example of FIG. 1A, the relatively thinner first end portion 16*a* of the shoe 10*a* is positioned generally beneath the heel H of the user. When muscles are relaxed, the relatively thinner first end portion 16*a* will rock back to the underlying surface, due to the weight of the user or wearer being concentrated generally over this first end portion 16*a*. In order to rock the shoe 10*a* forwardly onto the second end portion 20*a*, as shown in FIG. 1A, the user or wearer must contract the posterior muscles in the lower leg, i. e., the gastrocnemius G, etc.

In the example of FIG. 2A, the user has applied the shoe 10*b* embodiment so the first end 16*b* is positioned generally beneath the toes T and ball B of the foot F, thus placing the thicker and more highly cambered area of the second end 20*b* generally beneath the heel H. The user of the shoe 10*b* thus must rock the foot F forward to depress the first end portion 16*b* of the shoe 10*b*, thus contracting the anterior leg muscles, e. g., the tibialis anterior TA, extensor digitorum ED, and peronius longus PL, etc.

Any of the above described shoe embodiments 10*a* through 10*e*, and/or closely related constructions within the scope of the present disclosure, may be easily reversed longitudinally to provide exercise for the various muscle groups noted above. Thus, the present therapeutic rocking shoe invention provides alternate stretching and contraction exercises for the various muscle groups of the lower legs of the user, as well as exercising various other muscle groups of the upper legs, hips, lower back, etc., as the body is rocked forwardly and rearwardly using the present shoes. All of these various exercises are achievable using only a single pair of the present rocking shoes, with the shoes easily and quickly converted to place either end beneath either end of the foot, as desired by the user. The versatility and economy of the present rocking shoe invention thus provides a significant improvement over various other exercise shoes of the prior art, which cannot provide the versatility and economy of the present therapeutic walking shoe invention.

It is to be understood that the present invention is not limited to the embodiments described above, but encompasses any and all embodiments within the scope of the following claims.

I claim:

1. An exercise rocking shoe comprising:

a solid, integrally formed, monolithic structure having a first side, a second side, a length, a bottom outer sole surface, a flat, longitudinally and laterally symmetrical upper insole surface, a first end portion with a first tip, an opposite second end portion with a second tip, and an intermediate portion between said first end portion and said second end portion, said monolithic structure fabricated from a solid, impervious block of material selected from the group consisting of wood and plastic;

said bottom sole surface having a continuous longitudinal convex curvature from said first end portion to said second end portion;

said curvature of said bottom sole having a large radius at said first end portion, a small radius at said second end portion, and an intermediate radius across said intermediate portion, with said curvature continuously and smoothly blending from said first end portion across said intermediate portion to said second end portion;

a coating having a high coefficient of friction disposed on said upper insole surface and said bottom sole surface; and means for attaching and reversing the longitudinal orientation of said structure relative to a wearer's foot, whereby said first end portion and said second end portion can be selectively positioned beneath different portions of the wearer's foot as desired for varying exercise by the wearer.

2. The exercise rocking shoe according to claim 1, wherein said means for attaching and reversing includes a combination ankle-heel strap;

a toe strap;

first attachment means disposed adjacent said first end portion at said first side and said second side for selectively and removably securing said ankle-heel strap and said toe strap interchangeably thereto as desired; and second attachment means disposed adjacent said second end portion at said first side and said second side for selectively and removably securing said ankle-heel strap and said toe strap interchangeably thereto as desired.

3. The exercise rocking shoe according to claim 2, wherein said ankle-heel strap includes at least one first strap portion extending from said first side of said structure;

at least one second strap portion extending from said second side of said structure; and means for removably securing said first strap portion to said second strap portion.

4. The exercise rocking shoe according to claim 3, wherein said toe strap includes at least one first strap portion extending from said first side of said structure;

at least one second strap portion extending from said second side of said structure; and means for removably securing said first strap portion of said toe strap to said second strap portion of said toe strap.

5. The exercise rocking shoe according to claim 4, wherein said first tip is rounded for strengthening thereof.

* * * * *